US005692715A

United States Patent [19]

Hertel

[11] Patent Number: 5,692,715

[45] Date of Patent: Dec. 2, 1997

[54] CHAIR BASE HAVING DUAL-TAPERED LOCKING HUB

[75] Inventor: John Alexander Hertel, Maryhill, Canada

[73] Assignee: Plastic Prescriptions Limited, Ontario, Canada

[21] Appl. No.: 400,352

[22] Filed: Mar. 8, 1995

[30] Foreign Application Priority Data

Mar. 14, 1994 [GB] United Kingdom ..... 9404917

[51] Int. Cl.[6] ..... F16M 11/20

[52] U.S. Cl. ..... 248/188.8; 297/344.2

[58] Field of Search ..... 248/188.1, 188.7, 248/188.8, 163.1, 346.03, 440.1, 519; 297/344.2, 344.18, 344.19

[56] References Cited

U.S. PATENT DOCUMENTS

| | | | |
|---|---|---|---|
| 168,383 | 10/1875 | Doremus | 248/188.7 |
| 714,764 | 12/1902 | Watkins . | |
| 2,111,642 | 2/1938 | Saier | 248/519 X |
| 2,218,583 | 10/1940 | Marthaler | 155/194 |
| 2,490,210 | 12/1949 | Cramer et al. | 248/194 |
| 2,617,617 | 11/1952 | Krastel et al. | 248/519 X |
| 2,802,635 | 8/1957 | Englebart | 248/163.1 X |
| 3,223,368 | 12/1965 | Pollock | 248/158 |
| 3,323,833 | 6/1967 | Kasparian | 297/248 |
| 3,348,797 | 10/1967 | Turbyfill | 248/188.1 X |
| 3,877,669 | 4/1975 | Ambasz | 248/188.7 |
| 4,712,758 | 12/1987 | Cuschera | 248/188.7 |
| 4,821,986 | 4/1989 | White | 248/188.7 |
| 4,911,391 | 3/1990 | Ellis | 248/188.7 |
| 5,044,299 | 9/1991 | Frank | 297/344.18 X |
| 5,149,035 | 9/1992 | Bonnema et al. | 297/344.19 X |
| 5,377,943 | 1/1995 | Perl | 248/188.7 |
| 5,454,536 | 10/1995 | Melhuish | 248/188.7 |

FOREIGN PATENT DOCUMENTS

| | | | |
|---|---|---|---|
| 1471286 | 4/1968 | France | 248/188.8 |
| 2263657 | 7/1974 | Germany | 248/188.7 |
| 821587 | 10/1959 | United Kingdom | 248/188.8 |

*Primary Examiner*—Ramon O. Ramirez
*Attorney, Agent, or Firm*—Kalow, Springut & Bressler

[57] ABSTRACT

The chair base of the present invention has a dual-tapered locking hub. A first tapered portion is provided for a major portion of the internal core, and a second tapered portion is provided in the remainder of the internal core. The taper angle of the second portion is greater than the taper angle of the first portion. The first tapered portion prevents wobbling of the central column within the chair base after extensive use, whereas the second tapered portion prevents creeping of the central column through the chair base and locks in the central column.

7 Claims, 4 Drawing Sheets

CHAIR BASE HAVING DUAL-TAPERED LOCKING HUB

FIELD OF THE INVENTION

The present invention relates to bases for swivel-type chairs, and more particularly, to chair bases having a dual-tapered locking hub for use with chairs having central columns such as gas, mechanical, metal or plastic cylinders.

BACKGROUND OF THE INVENTION

Chairs of the type having swivelling seats and supporting bases have long been provided in the art. Such swivel-type chairs typically include a central column such as a gas, mechanical, metal or plastic cylinder between the chair and the base allowing the chair portion to swivel and to be moved up or down as required. In the older swivel-type chairs, the column was typically made of metal, that is, it usually included a metal outer casing. The metal column was intended to be inserted into a metal insert in the centre (hub) of the chair base. When the metal column and metal insert were engaged together, they provided a generally satisfactory "seat", that is, the two parts did not fall apart and there generally was no wobbling of the column. One drawback, however, with the older metal columns and metal inserts is that they require relative expensive methods of manufacturing. The costs of the metal material itself, as well as the costs of forming and painting of the metal outer casing of the column are relatively high.

Another drawback with using a metal column inserted into a metal insert is that the seating action is always subject to manufacturing tolerances. Due to discrepancies in these manufacturing tolerances, the seating action may not always be positive. That is, there may not always be a snug, cooperating fit between the metal column and the metal insert. This non-positive seating action may result in wobbling of the metal column within the metal insert, thereby resulting in wobbling of the entire chair, which is not acceptable.

In recent years, there has been a switch to using plastic materials for construction of both the column and base. However, because plastic material is generally more flexible than metal, it has proved to be very difficult to prevent the column from creeping through the chair base after extensive use, unless the base includes an internal step to prevent such creeping.

SUMMARY OF THE INVENTION

According to one aspect of the present invention, a base for a swivel-type chair is provided in which the base includes a central hub for receiving and retaining therein a central column connecting the base with the seat of the chair, the improvement comprising the hub having a first tapered portion extending for a major portion of the length of the hub, and a second tapered portion extending for the remaining length of the hub, wherein the taper angle of the second tapered portion is greater than the taper angle of the first tapered portion so that one end of the central column is received and retained within the hub.

According to a further aspect of the present invention, the one end of the central column has a diameter such that the one end engages the second tapered portion when the one end of the central column is received in the hub.

BRIEF DESCRIPTION OF THE DRAWINGS

The present invention will be described in detail with reference to the accompanying drawings, in which like numerals denote like parts in the several views, and in which.

DETAILED DESCRIPTION OF THE PREFERRED EMBODIMENT

Figure 1:
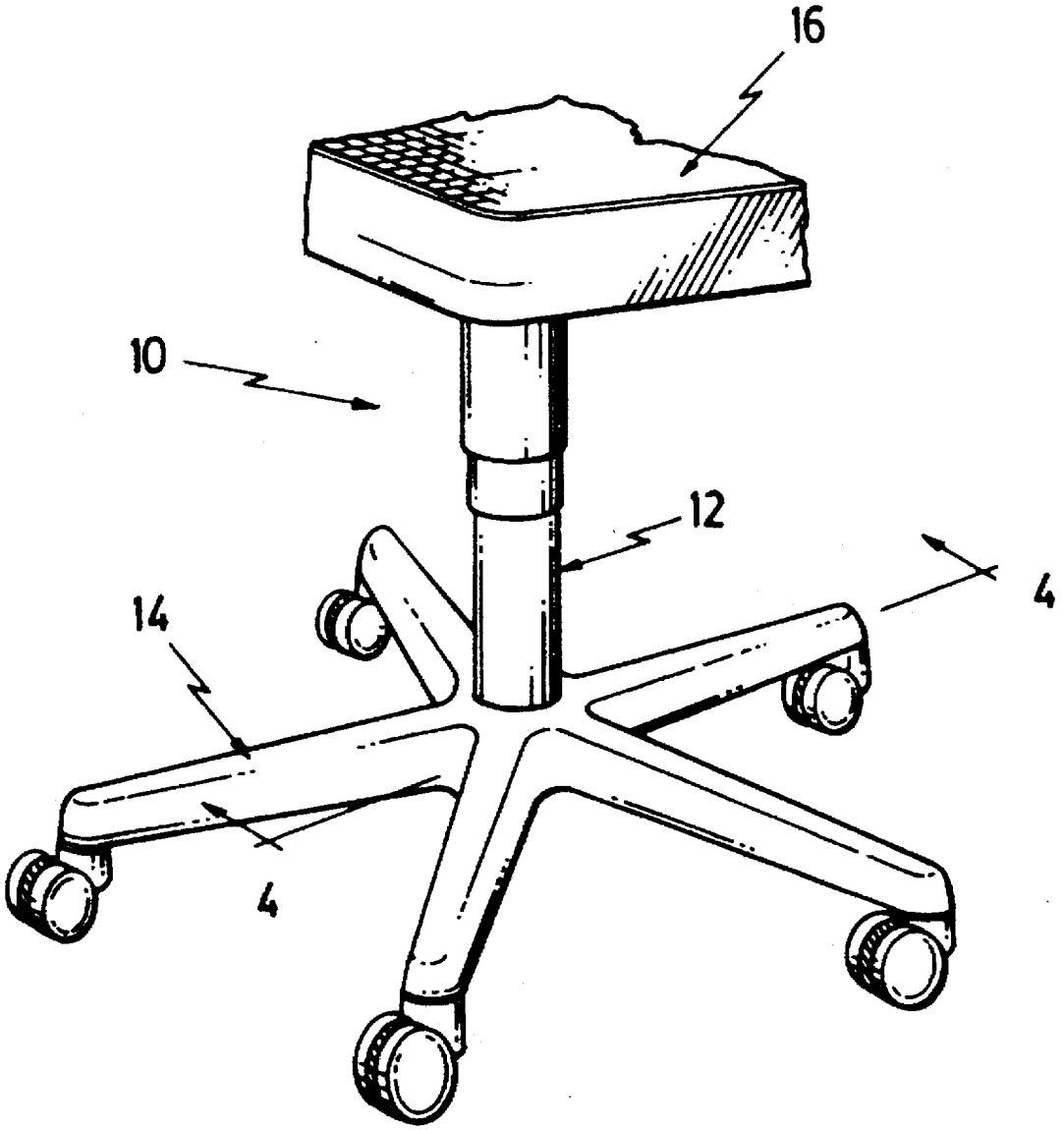
FIG. 1 is a partial perspective view of a swivel-type chair having a seat, central column and base.

In FIG. 1, a swivel-type chair is illustrated. The chair 10 includes a central column 12, such as a gas, mechanical, metal, plastic or other type of cylinder, base 14 and seat 16. The column 12 allows the seat 16 to be moved up or down as required by the user, and also allows the seat 16 to swivel, that is rotate about the vertical axis.

Figure 2:
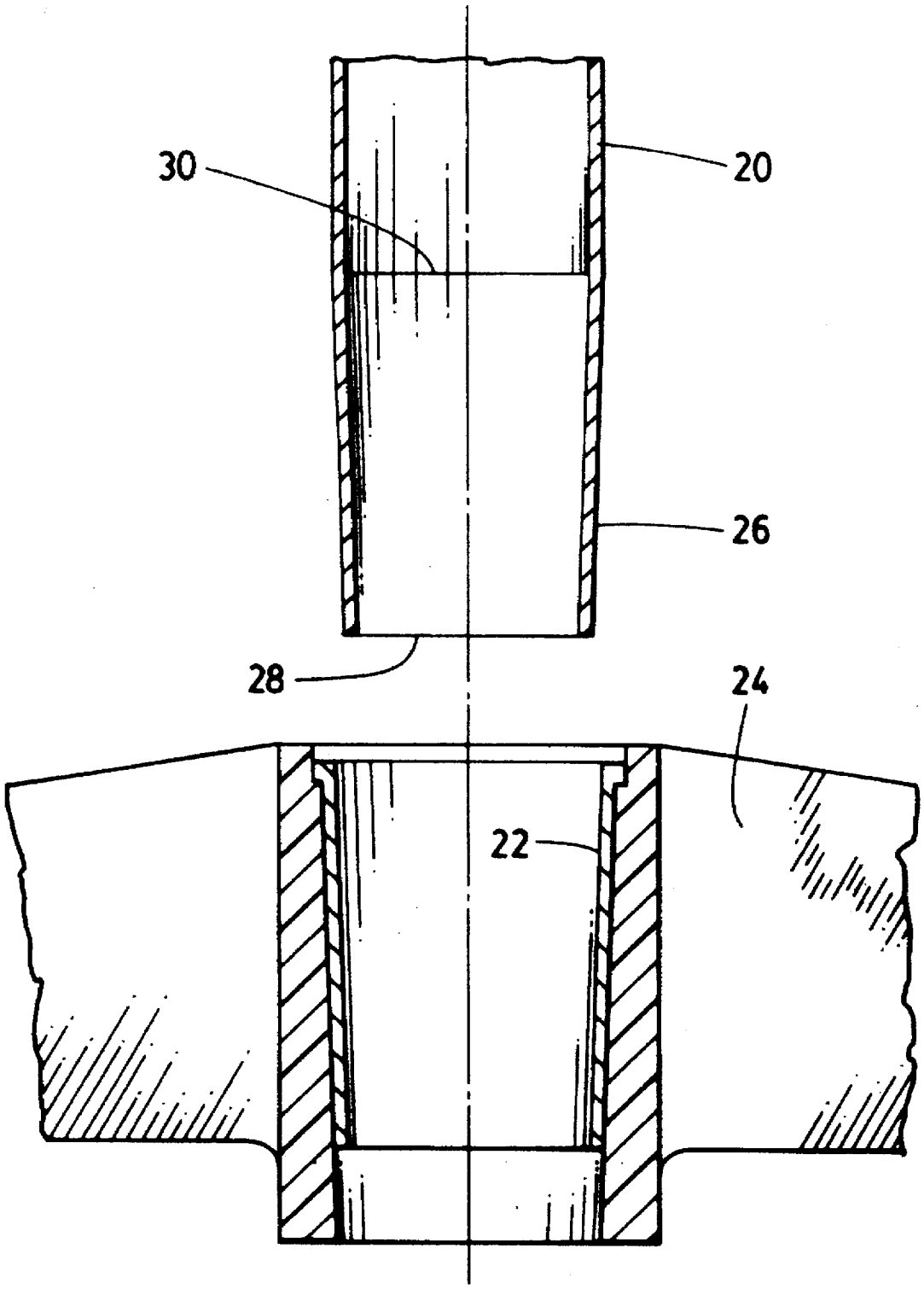
FIG. 2 PRIOR ART
FIG. 2 is a cross-sectional view of one prior art embodiment of the central column and base in which a tapered metal insert is used.

With reference to FIG. 2, there is shown a metal gas cylinder 20 and metal insert 22 of the prior art. The metal insert 22 is located within the central area of the base 24 of the chair. The end 28 of the metal gas cylinder 20 includes a metal outer casing 26 which is intended to be inserted into the metal insert 22. As shown in FIG. 2, the sides of both the metal insert 22 and the metal outer casing 26 (from the end 28 to line 30) are tapered. With reference specifically to the outer casing 26 of the metal gas cylinder 20, the metal casing 26 has a smaller diameter at the end of the gas cylinder 20 compared to the diameter at the casing's other end. The sides of the metal insert 22 are similarly tapered so that when the metal gas cylinder 20 is inserted into the metal insert 22, it is intended to fit snugly within the metal insert 22 and be retained therein.

In a typical swivel-type chair, there is a fair amount of pressure that must be withstood by the metal gas cylinder 20 within the metal insert 22. The tapering shown in FIG. 2 allows the gas cylinder 20 to be retained within the metal insert 22, thus the gas cylinder 20 does not creep downwardly through the metal insert 22.

Recently, central columns and chair bases have been manufactured entirely of plastic material. The advantage to this is that the relatively high costs of the metal outer casing and metal insert are eliminated by having the components made entirely of plastic. In particular, the cost of the forming and painting operations of the column are eliminated.

Referring once again to FIG. 2, if the central column and the central area (hub) of the chair base are made entirely of plastic, and each has the same taper as shown in FIG. 2, the central column (gas cylinder) may begin to distort after excessive use, since the plastic is substantially more supple than metal. That is, although initially the plastic column will be retained within the tapered hub of the plastic base, after some use of the chair, the loads and pressures generated from such use will cause distortions within the plastic column, thereby allowing the column to eventually creep through the tapered hub of the plastic base. This will result in lowering of the chair and eventual total failure of the chair itself.

Figure 3:
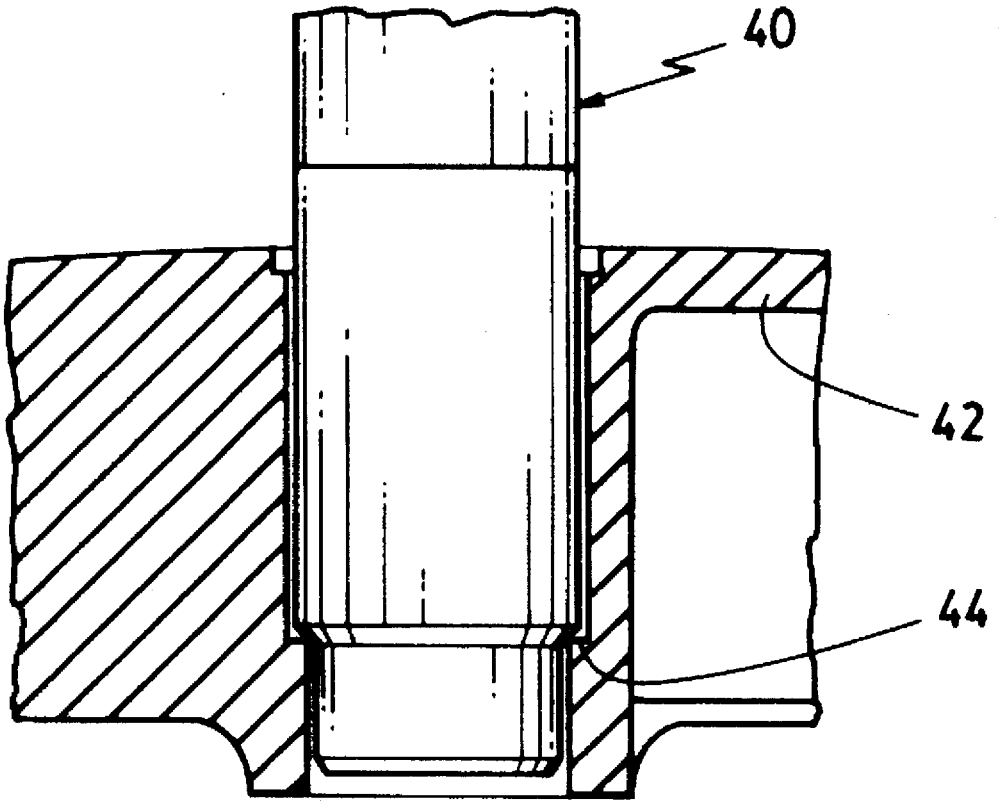
FIG. 3 PRIOR ART
FIG. 3 is a cross-sectional view of a second prior art embodiment of the central column and base in which an internal step is provided in the hub.

FIG. 3 illustrates one solution to the problem of creeping of the plastic central column 40 through the hub of the plastic base 42. The problem has been addressed by removing the taper as the holding mechanism, and replacing it with an internal step 44 designed to prevent creeping of the column through the hub of the chair base. As shown in FIG. 3, the plastic central column 40 is retained within the hub of the base 42 by means of the internal step 44. One disadvantage with the internal step design of FIG. 3 is that loads and pressures applied to the chair through use will eventually cause the plastic central column 40 and plastic base 42 to distort. This will loosen the fit of the column 40 within the plastic base 42 and cause the column 40 to bottom out on the step 44. Once the column 40 bottoms out, the continued use of the chair will result in further distortions, causing the chair to rock, thereby also leading to a general failure of the chair.

Figure 4:
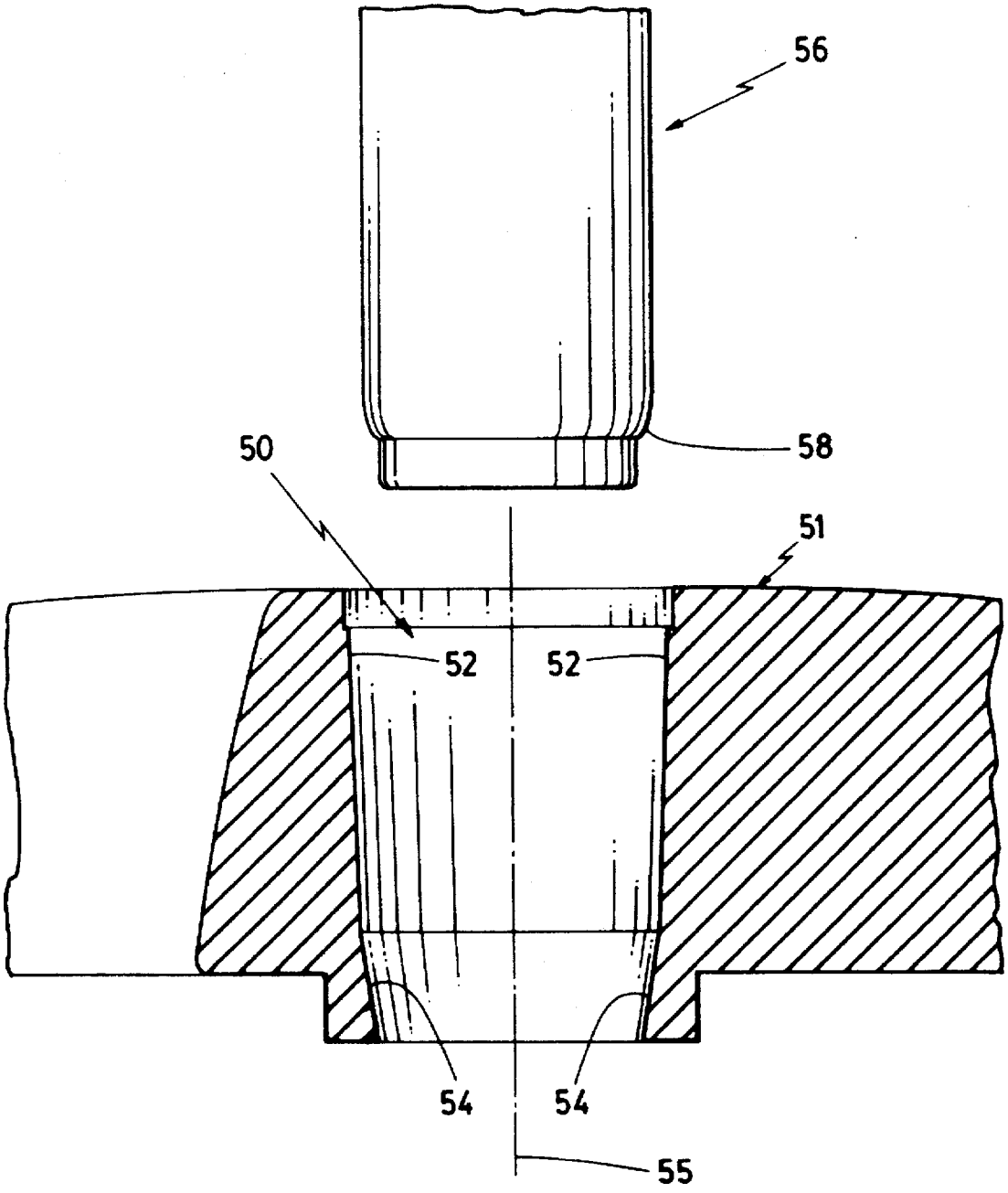
FIG. 4 is cross-sectional view of a portion of the central column and base of the present invention in which the base includes a dual-tapered hub for locking the column in place.

The present invention reduces or eliminates the disadvantages encountered with the prior art by providing a chair base having a hub with a dual-tapered locking mechanism for the central column. As illustrated in FIG. 4, the hub 50 of the chair base 51 includes a first tapered portion 52 that extends for a major portion of the length of the hub 50. A second tapered portion 54 extends for the remaining length of the hub 50. According to the present invention, the second tapered portion 54 has a taper angle greater than the taper angle of the first tapered portion 52. By "taper angle" it is meant the angle defined by the internal wall of the tapered portion and the vertical axis (illustrated by the dotted line 55). As well, it will be understood that the taper angle of the second tapered portion 54 will be less than 90°, otherwise the second tapered portion 54 will, in effect, be an internal step as in the prior art (FIG. 2).

In one preferred embodiment of the present invention, the taper angle of the first tapered portion 52 is in the range of 2° to 15°, whereas the taper angle of the second tapered portion 54 is in the range of 5° to 75°. In a more preferred embodiment, the taper angle of the first tapered portion 52 is in the range of 2° to 5°, whereas the taper angle of the second tapered portion 54 is in the range of 7° to 50°. In the most preferred embodiment, the taper angle of the first tapered portion 52 is 2°, whereas the taper angle of the second tapered portion 54 is 9°.

The length and diameter of the hub 50 of the chair base 51 will generally vary depending on the size of chair. As used herein, the length of the hub refers to the distance between the point where the first tapered portion 52 begins and the point where the second tapered portion 54 ends. In the present invention, the first tapered portion 52 will extend for the majority of the length of the hub 50. Preferably, the first tapered portion 52 will extend for between 50% and 75% of the length of the hub, whereas the second tapered portion 54 will extend for the remainder of the length of the hub 50. In a most preferred embodiment, the length of the hub 50 is 25%.

The central column 56 intended to be fitted within the hub 50 of the chair base 51 of the present invention may be made of ant type of material, such as metal or plastic. As well, the column 56 may have an end 58 that is tapered with the angle of taper of the column 56 preferably corresponding to the taper angle of the first tapered portion 52 of the hub 50. Thus, when the gas column 56 is inserted within the hub 50 of the present invention, the column 56 will be inserted until the end 58 of the column 56 reaches the second tapered portion 54. The greater tapered angle of the second tapered portion 54 will act to retain the central column 56 with the hub 50 of the plastic chair base 51 and prevent the column 56 from creeping therethrough. With further use of the chair, the added loads and pressures on the column 56 may cause it to creep down into the hub 50 to some extent, however the end 58 of the column 56 will "lock" itself into the second tapered portion 52 due to the decreasing diameter of the hub 50.

One of the advantages of the dual-tapered hub 50 design of the present invention is that the first tapered portion 52 will prevent wobbling of the central column 56 within the chair base 51, even after extended use and some distortion of the column 56 and/or chair base 51. A further advantage of the dual-tapered hub 50 is that the second tapered portion 54 will act to prevent creeping of the central column 56 through the chair base 51 and also lock the central column 56 into the chair base 51 to firmly retain it therein. There may be some very minor creeping of the central column 56 within the hub 50 after excessive use, however, because of the greater taper angle on the second tapered portion 54, the central column 56 will be prevented from creeping right through the hub 50. Thus the functionality and integrity of the overall chair remains intact through use.

In summary, the chair base of the present invention comprises a dual-tapered locking hub. A first tapered portion is provided for a major portion of the hub, and a second tapered portion is provided in the remainder of the hub. The taper angle of the first portion is less than the taper angle of the second tapered portion. The first tapered portion prevents wobbling of the central column within the chair base, whereas the second tapered portion prevents creeping of the central column through the chair base and locks the central column in the hub.

Modifications and alterations are possible and all such modifications and alterations are within the sphere and scope of the present invention as described herein.

I claim:

1. In a base for a swivel-type chair in which the base includes a central hub for receiving and retaining therein a central column connecting the base with the seat of the chair, the improvement comprising:

the hub having a first tapered portion extending for a major portion of the length of the hub, and a second tapered portion having a taper angle extending for the remaining length of the hub, the first and second tapered portion each having upper diameters greater than their respective lower diameters, wherein the lower diameter of the first tapered portion is equal to the upper diameter of the second tapered portion, wherein the taper angle of the second tapered portion is greater than the taper angle of the first tapered portion so that one end of the column is received and substantially firmly retained within the hub and whereby the greater taper angle of the second tapered portion prevents substantial creeping of the column through the base and thereby substantially firmly locks the column in the hub and the first tapered portion prevents wobbling of the column within the base.

2. The improvement of claim 1, in which the first tapered portion extends for between 50% and 75% of the length of the hub.

3. The improvement of claim 1, in which the taper angle of the second tapered portion is in the range of 5° and 75°, and the taper angle of the first tapered portion is in the range of 2° and 15°.

4. The improvement of claim 3, in which the taper angle of the second tapered portion is in the range of 7° and 50°, and the taper angle of the first tapered portion is in the range of 2° and 5°.

5. The improvement of claim 4, in which the taper angle of the second tapered portion is 9°, and the taper angle of the first tapered portion is 2°.

6. The improvement of claim 2, in which the second tapered portion extends for 25% of the length of the hub, and the first tapered portion extends for 75% of the length of the hub.

7. The improvement of any one of claims 1, 3, 4 or 5, in which the second tapered portion substantially firmly locks the column into place and prevents the column from creeping down through the hub.

* * * * *